US005159821A

United States Patent [19]

Nakamura

[11] Patent Number: 5,159,821

[45] Date of Patent: Nov. 3, 1992

[54] RECEIVER TANK

[75] Inventor: Miki Nakamura, Konan, Japan

[73] Assignee: Zexel Corporation, Tokyo, Japan

[21] Appl. No.: 740,618

[22] Filed: Aug. 5, 1991

[30] Foreign Application Priority Data

Aug. 23, 1990 [JP] Japan ..... 2-222024

[51] Int. Cl.[5] ..... F25B 39/04

[52] U.S. Cl. ..... 62/509; 62/512; 165/110; 165/132

[58] Field of Search ..... 62/509, 512; 165/110, 165/132

[56] References Cited

U.S. PATENT DOCUMENTS

| | | | |
|---|---|---|---|
| 2,081,303 | 5/1937 | Karmazin | 165/132 |
| 2,181,354 | 11/1939 | Winters | 165/132 |
| 2,691,279 | 10/1954 | Anderson | 165/132 |
| 3,922,880 | 12/1975 | Morris | 62/506 |
| 4,707,999 | 11/1987 | Ohta et al. | 62/509 |
| 4,972,683 | 11/1990 | Beatenbough | 62/509 |
| 5,088,294 | 2/1992 | Ando | 62/509 |

*Primary Examiner*—Ronald C. Capossela
*Attorney, Agent, or Firm*—Wenderoth, Lind & Ponack

[57] ABSTRACT

A receiver tank includes a container extending vertically along one of two spaced opposed header pipes of a condenser, a guide pipe extending from a lower end of the one header pipe into the internal space in the container and further extending upwardly within the container, the guide pipe having a number of perforations at an upper portion thereof for guiding a refrigerant into the container, and a refrigerant outlet pipe connected at a lower end portion of the container for discharging the refrigerant from the container. The guide pipe is inserted into the container from the bottom end thereof and guides the refrigerant from the condenser into an upper part of the container. The receiver tank having such guide pipe and container is easy to assembly. The refrigerant flows out from perforations formed at the upper portion of the guide pipe and then falls down toward the bottom of the receiver tank so that a vapor-liquid separation process can be performed efficiently.

11 Claims, 2 Drawing Sheets

RECEIVER TANK

BACKGROUND OF THE INVENTION

1. Field of the Invention

The present invention relates to a receiver tank disposed adjacent to a condenser so as to constitute a portion of a refrigeration system for performing a refrigeration cycle.

2. Description of the Prior Art

An example of the receiver tanks of the type concerned is disclosed in Japanese Patent Publication No. 53-6737. The disclosed receiver tank has a partition wall formed integrally with the peripheral wall of the receiver tank along the length thereof for separating the internal space of the receiver tank into three chambers, namely an inlet side communication chamber, a storage chamber, and an outlet side communication chamber. The inlet side communication chamber is connected at its lower end with a tube extending from a condenser for introducing a refrigerant in the liquid state into the inlet side communication chamber and thence to an upper part of the internal space of the receiver tank. The refrigerant flowing upwardly along the partition wall is then turned down at an upper end of the partition wall and falls into the bottom of the storage chamber so that a liquid refrigerant stored in the storage chamber is forced out or discharged from an outlet at a predetermined pressure via the outlet side communication chamber.

With the receiver tank of the foregoing construction, the partition wall is integrally formed by stamping, for example, with the receiver tank so as to define the inlet side communication chamber, the storage chamber and the outlet side communication chamber. The partition wall requires a complicated finishing processes such as cutting of a part of the partition wall for providing a fluid-communication between the inlet side communication chamber and the storage chamber and also between the storage chamber and the outlet side communication chamber. In addition, since the refrigerant flows from the upper end of the inlet side communication chamber directly into the storage chamber, an adequate vapor-liquid separation is difficult to perform.

SUMMARY OF THE INVENTION

With the foregoing difficulties of the prior art in view, it is an object of the present invention to provide a receiver tank which is easy to assemble and capable of adequately performing a vapor-liquid separation.

According to the present invention, there is provided a receiver tank disposed adjacent to a condenser including a pair of spaced opposed confronting vertical header pipes interconnected in fluid communication by a plurality of horizontal tubes, with a fin disposed between each adjacent pair of the tubes, for receiving a refrigerant and finally introducing the received refrigerant into a lower part of one of the header pipes, the receiver tank comprising: a substantially tubular container disposed vertically along said one header pipe; a guide pipe extending from a lower portion of said one header pipe into the container and further extending upwardly within the container along the length thereof, the guide pipe including an upper portion disposed within the container and having a number of perforations through which the refrigerant is introduced from said one header pipe into the container; and a refrigerant outlet pipe connected at one end thereof with a lower end portion of the container for discharging the refrigerant from the container.

With this construction, the refrigerant is guided into the upper portion of the receiver tank through the guide pipe which extends from a lower end toward an upper portion of the tubular container. The guide pipe can be disposed within the tubular container without the need for a machining of the tubular container. The refrigerant guided to an upper portion of the guide pipe flows out from the perforations formed in this upper portion and then is stored at a lower portion of the receiver tank so that gaseous contents in the refrigerant can effectively be separated.

The above and other objects, features and advantages of the present invention will become manifest to those versed in the art upon making reference to the detailed description and the accompanying sheets of drawings in which preferred structural embodiments incorporating the principles of the present invention are shown by way of illustrative examples.

DETAILED DESCRIPTION

The present invention will be described hereinbelow in greater detail with reference to certain preferred embodiments shown in the accompanying drawings.

Figure 1:
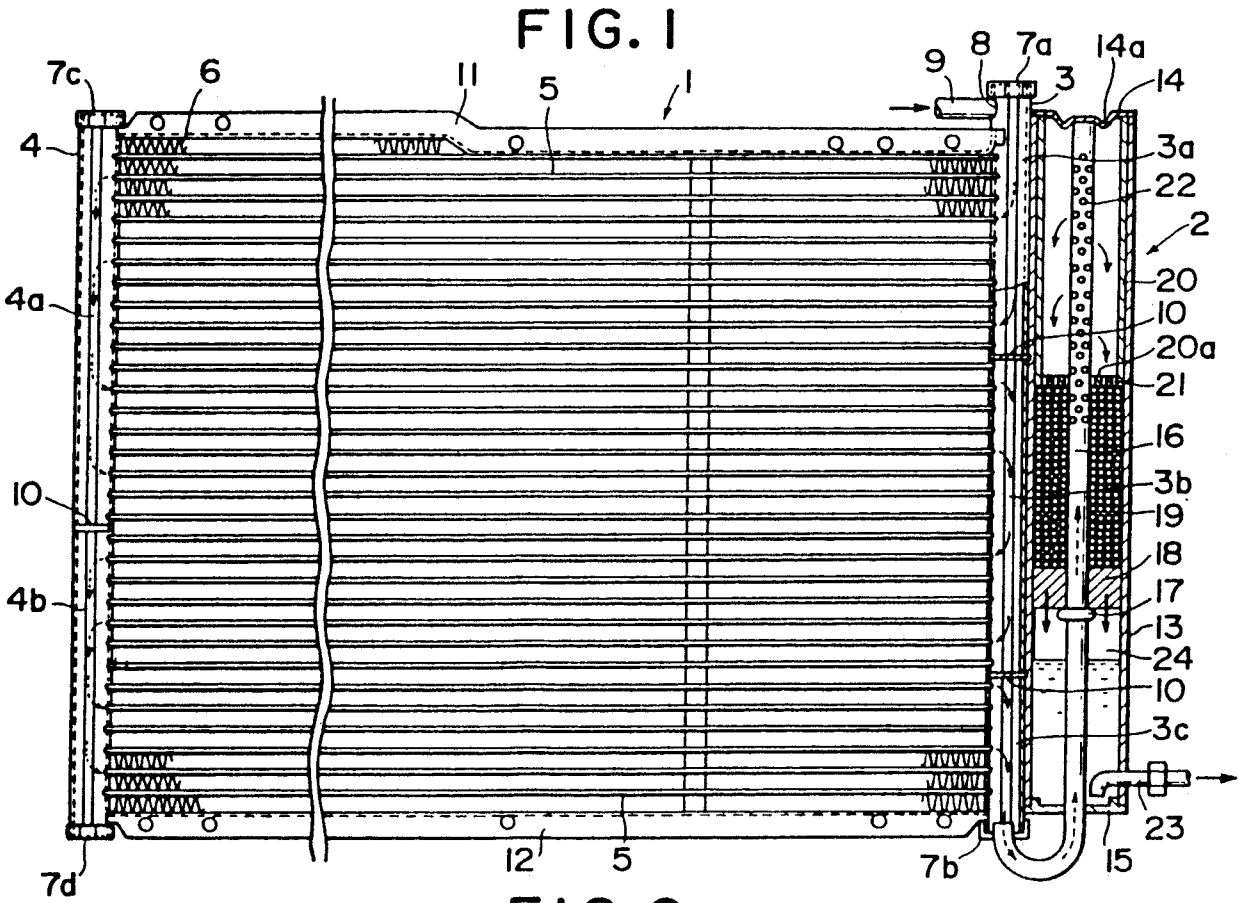
FIG. 1 is a cross-sectional view, with parts removed for clarity, of a receiver tank according to the invention and a condenser joined with the receiver tank.

FIG. 1 shows a condenser 1 and a receiver tank 2 which constitute a refrigeration system for performing a refrigeration cycle of an automotive air-conditioner.

The condenser 1 subjects a refrigerant which is compressed at a high pressure by a compressor (not shown), to a heat radiating process, thereby converting the refrigerant from a gaseous or vapor state into a liquid state. The condenser 1 is made of metal such as aluminum as a whole and, as shown in FIG. 1, it is composed of a pair of vertically disposed, spaced opposed header pipes 3, 4 interconnected by a plurality of horizontal flat tubes 5.

Each of the header pipes 3, 4 is composed of a pair of pipe halves or members of a semi-circular cross-section joined together into a tubular shape. Opposite ends (upper and lower ends) of the header pipe 3 are closed by upper and lower end caps 7*a* and 7*b*, while opposite ends (upper and lower ends) of the header pipe 4 are closed by upper and lower end caps 7*c* and 7*d*). The header pipes 3, 4 are connected in fluid communication with each other by the flat tubes 5 which are connected at opposite ends to the header pipes 3, 4 and communicate with the internal spaces of the header pipes 3, 4 through connecting holes formed in the peripheral walls of the respective header pipes 3, 4.

A high-pressure pipe 9 is connected to the header pipe 3 adjacent to the upper end thereof for connecting a compressor, not shown, with the condenser 1 via a connecting hole 8 in the header pipe 3. A plurality of partition walls 10 (two in the illustrated embodiment) are disposed in the header pipe 3 so as to separate the internal space of the header pipe 3 into an upper header portion 3a, an intermediate header portion 3b and a lower header portion 3c. In the illustrated embodiment, the upper header portion 3a communicates with ten flat tubes 5, the intermediate header portion 3b communicates with fifteen flat tubes 5, and the lower header portion 3c communicates with six flat tubes 5.

The header pipe 4 has an internal partition wall 10 disposed at an intermediate portion of the header pipe 4 so that the internal space of the header pipe 4 is divided by the partition wall 10 into an upper header portion 4a to which eighteen flat tubes 5 are connected, and a lower header portion 4b to which thirteen header tubes 5 are connected.

Upper and lower mounting plates 11, 12 are disposed on upper and lower ends of the condenser 1 with a corrugated fin 6 disposed between each mounting plate 11, 12 and an endmost one of the flat tubes 5. The mounting plates 11, 12 are secured at opposite ends to the header pipes 3, 4. Corrugated fins 6 are disposed between the adjacent flat tubes 6.

With this construction, the refrigerant fed from the compressor into the condenser 1 via the high-pressure pipe 9 flows from the upper header portion 3a of the header pipe 3 through the flat tubes 5 into the upper header portion 4a of the header pipe 4 which extends downward to a level lower than the bottom end of the upper header portion 3a. From the upper header portion 4a of the header pipe 4, the refrigerant flows back through the flat tube 5 into the intermediate header portion 3b of the header pipe 3 whose bottom end is disposed below the bottom end of the upper header portion 4a of the header pipe 4. Then, the refrigerant flows from the intermediate header portion 3b through the flat tubes 5 into the lower header portion 4a of the header pipe 4 from which the refrigerant flows back into the lower header portion 3c of the header pipe 3.

The receiver tank 2 is provided with a container 13 secured by brazing to the header pipe 3 of the condenser 1.

The container 13 has an elongate hollow cylindrical shape and the length of the hollow cylindrical container 13 is substantially the same as the length of the header pipe 3. Opposite ends (upper and lower ends) of the container 13 are closed by upper and lower end covers 14, 15. A guide pipe 16 bent into a substantially J-shape has one end (a lower end) connected to the lower header portion 3c of the header pipe 3 through the lower end cap 7b. The J-shaped guide pipe 16 extends through the lower end cover 15 into the internal space of the container 13 and further extends upwardly along a central axis of the container 13 until the opposite end (the upper end) of the guide pipe 16 engages the upper end cover 14. The upper end cover 14 has an annular central recess forming a complementary annular retaining projection 14a which holds the upper end of the guide pipe 16 to position the guide pipe 16 within the container 13.

A filter 18 is disposed in the container 13 at a substantially central portion thereof and positioned on an annular flange 17 formed on the guide pipe 16. A reticular dryer 19 is disposed above the filter 18 and held in a somewhat compressed condition by and between the filter 18 and a cup-shaped spacer 20 disposed on the dryer 19 within the container 13. The filter 18 is made of metal or ceramics and capable of withstanding a temperature of 600° C. without causing meltdown. The dryer 19 is made of a synthetic zeolite, for example, which is capable of withstanding a temperature of 600° C. without causing meltdown.

The cup-shaped spacer 20 has a number of small holes 21 formed in a bottom wall 20a which is held in contact with the dryer 19. The guide pipe 16 has a number of perforations 22 formed in an upper portion which extends from an upper portion of the dryer 19 to the upper end cover 14. Thus, there is a refrigerant flow passage 24 defined around the guide pipe 16 and extending vertically downwardly from the upper portion of the container 13 around the guide pipe 16 from the upper portion of the container 14 to the bottom end of the container 13 adjacent to which a refrigerant outlet pipe 23 is connected to the container 13.

With the receiver tank 2 thus constructed, the refrigerant, which is fed into the lower header portion 3c of the header pipe 3 of the condenser 1, is guided by the guide pipe 16 into an upper portion of the container 13 from which the refrigerant flows out from the guide pipe 16 through perforations 22 into the internal space of the container 13. A part of the refrigerant which is discharged from those perforations 22 of the guide pipe 16 located at an upper part of the dryer 19 flows directly through the dryer 19. Conversely, a part of the refrigerant which is discharged from those perforations 22 disposed above the dryer 19, flows into the spacer 20, then passes through the small holes 22 in the bottom wall 20a of the spacer 20, and moves into the dryer 19. The refrigerant, as it passes through the dryer 19 and then through the filter 18, is subjected to a vapor-liquid separation process to remove gaseous contents. Thereafter, the refrigerant is stored at the lower part of the container 13 and then delivered from the refrigerant outlet pipe 23 into an expansion valve (not shown). Since the container 13 is elongate and hence provides a relatively long flow path, and since the refrigerant is guided into the flow passage 24 via the perforations 22 in the guide pipe 16, the vapor-liquid separation process can be performed adequately and efficiently.

To assemble the receiver tank 2, the guide pipe 16 and the refrigerant outlet pipe 23 are received in and secured to the container 13. Then, after the filter 18 and the dryer 19 are fitted into the container 13 from an upper end thereof, a spacer 20 is fitted into the container 13 from the upper end thereof. Thereafter, the upper end cover 14 is attached to the container 13. The receiver tank 2 is thus preassembled. This preassembling of the receiver tank 2 is performed at the same time when the condenser 1 is being assembled. While keeping this preassembled condition, the receiver tank 2 is framed into a final shape by being brazed in a furnace.

The filter 18 and the dryer 19 are made of heat-resistant materials as described above and hence are free from deterioration and damage even when they are heated in the furnace together with the condenser 1.

Figure 2:
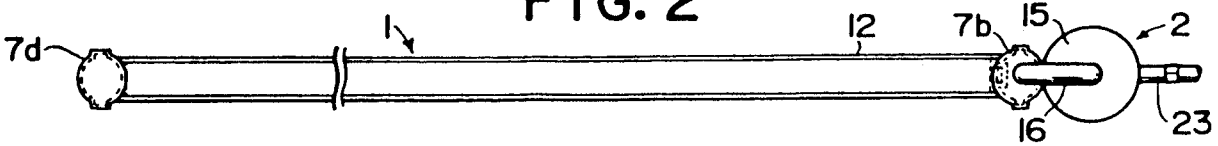
FIG. 2 is a bottom view of the tank and condenser of FIG. 1.
Figure 3:
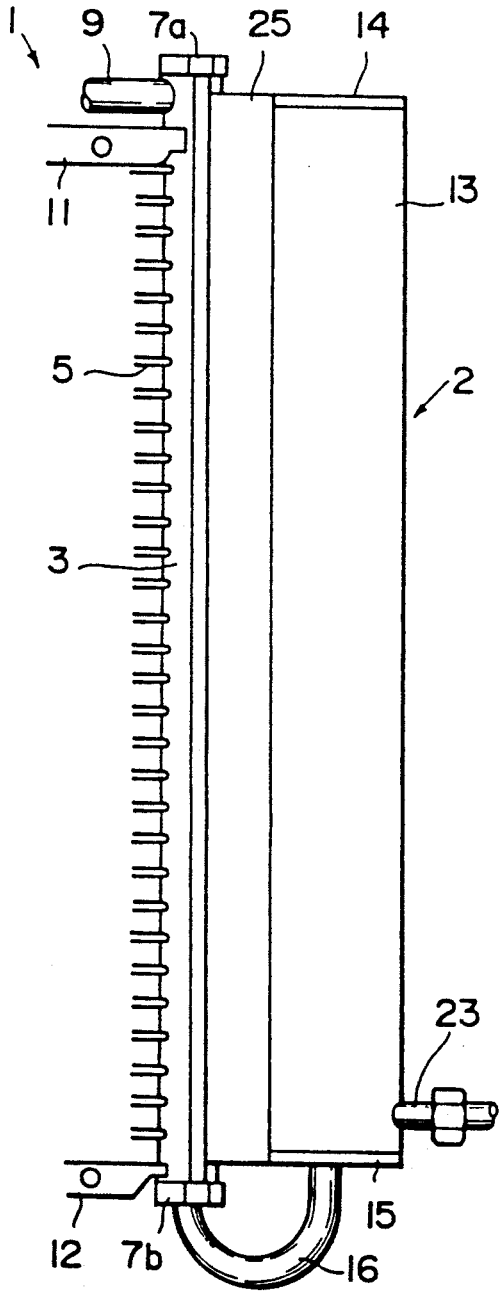
FIG. 3 is a front elevational view showing a joint structure between the condenser and the receiver tank according to another embodiment of the present invention.
Figure 4:
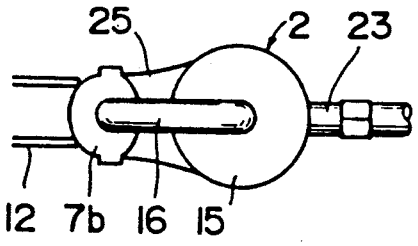
FIG. 4 is a bottom view of the joint structure of FIG. 3.

FIGS. 3 and 4 show a joint structure between the receiver tank 2 and the condenser 1 according to another embodiment of this invention. The condenser 1 an the receiver tank 2 are structurally the same as those of the first embodiment shown in FIGS. 1 and 2. The container 13 of the receiver tank 2 is, however, not joined by brazing with the header pipe 3 of the condenser 1 but is attached to the header pipe 3 by an elongate heat-insulating material 25.

The heat-insulating material 25 is effective to prevent the refrigerant from being partially converted within the receiver tank 2 from a liquid state into a gaseous state which would otherwise be caused when a high temperature refrigerant supplied from the compressor is transferred directly from the condenser 1 to the receiver tank 2.

Figure 5:
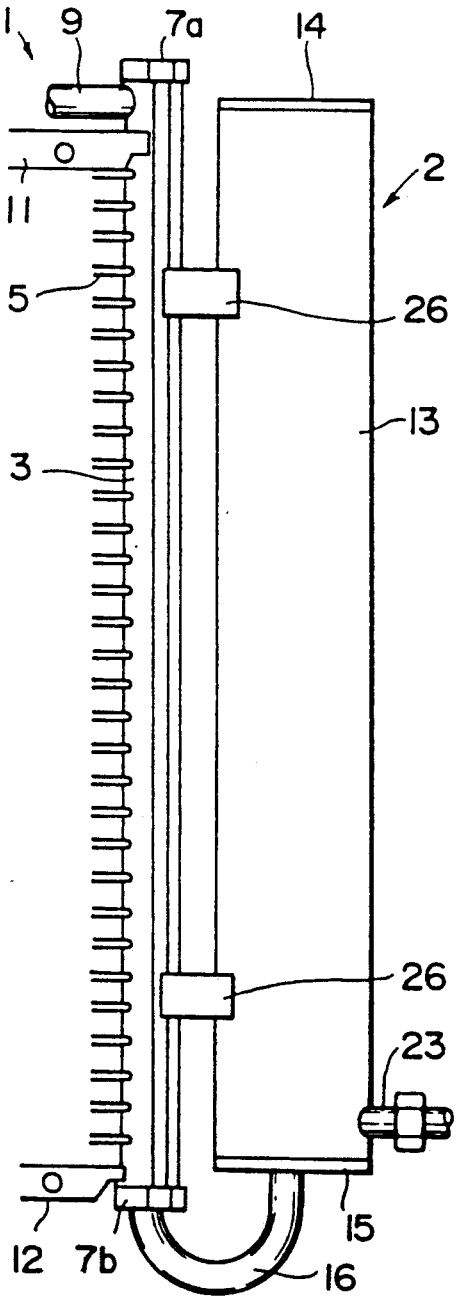
FIG. 5 is a front elevational view showing a joint structure of the condenser and the receiver tank according to another embodiment of this invention.
Figure 6:
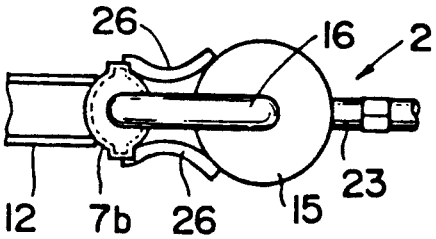
FIG. 6 is a bottom view of the joint structure of FIG. 5.

According to the invention, various means other than the heat-insulating material 25 may be employed so as to prevent reheating of the refrigerant stored in the receiver tank 2 to maintain the refrigerant in the liquid state. For example, as shown in FIGS. 5 and 6, the receiver tank 2 may be attached to the header pipe 3 by a pair of brackets 26, with a space defined between the receiver tank 2 and the header pipe 3. The brackets 26, the condenser 1 an the receiver tank 2 are assembled together by brazing in a furnace.

As described above, according to the present invention, a guide pipe is inserted into a container from the bottom end thereof and extends upwardly so as to guide a refrigerant from the condenser into an upper part of the container. A receiver tank having such guide pipe and container can be assembled with utmost ease. The refrigerant flows out from perforations formed at an upper portion of the guide pipe and then falls down toward the bottom of the receiver tank so that a vapor-liquid separation process can be performed efficiently.

Obviously, various modifications and variations of the present invention are possible in the light of the above teaching. It is therefore to be understood that within the scope of the appended claims the present invention may be practiced otherwise than as specifically described.

What is claimed:

1. A liquid refrigerant receiver tank for use with a refrigerant condenser, the condenser having a pair of spaced opposed vertical header pipes interconnected in fluid communication by a plurality of horizontal tubes, and a fin disposed between each adjacent pair of tubes, the condenser receiving a gaseous refrigerant and passing it therethrough and condensing it into a liquid and finally collecting the condensed liquid refrigerant in a lower part of one of the header pipes, said receiver tank comprising:

a substantially tubular container disposed vertically along and beside the outside of the one header pipe;

a liquid refrigerant guide pipe extending from the lower part of the one header pipe into said container and further extending upwardly within said container along the length thereof, said guide pipe including an upper portion disposed within said container and having a number of perforations, said guide pipe conducting liquid refrigerant from one header pipe into said container and introducing it into the interior of said container through said perforations; and a liquid refrigerant outlet pipe connected at one end thereof with a lower end portion of said container for discharging the liquid refrigerant from said lower end portion of said container.

2. A receiver tank according to claim 12 wherein said container comprises an elongate hollow cylinder having a length substantially the same as the length of the one header pipe and closed at opposite ends by end covers.

3. A receiver tank according to claim 2 wherein said guide pipe has an upper end by one of said end covers which closes an upper end of said container for positioning said upper end.

4. A receiver tank according to claim 2 wherein said guide pipe extends from a lower end of the one header pipe and projects into said container through said end cover which closes the lower end of said container.

5. A receiver tank according to claim 2 wherein said container includes a filter and a dryer disposed within said container substantially at a central portion thereof.

6. A receiver tank according to claim 5 wherein said guide pipe has a flange and said filter is supported on said flange.

7. A receiver tank according to claim 6 wherein said dryer is disposed above said filter, further including a spacer disposed above said dryer and holding said dryer in a compressed condition between said dryer and said filter.

8. A receiver tank according to claim 7 wherein said spacer comprises a tube having a bottom wall held in contact with said dryer, said bottom wall having a number of small holes.

9. A receiver tank according to claim 8 wherein said bottom wall of said tubular spacer is disposed below a major part of said perforations in said upper portion of said guide pipe.

10. A receiver tank according to claim 2 wherein said container is attached to said one header pipe via a heat insulating material.

11. A receiver tank according to claim 2 wherein said container is attached to said one header pipe via at least one bracket with a space defined between said container and said one header pipe.

* * * * *